United States Patent [19]

Mägdefessel

[11] Patent Number: 4,534,708

[45] Date of Patent: Aug. 13, 1985

[54] GETTER SORPTION PUMP WITH HEAT ACCUMULATOR FOR HIGH-VACUUM AND GAS DISCHARGE SYSTEMS

[75] Inventor: Heinz Mägdefessel, Haslach, Fed. Rep. of Germany

[73] Assignee: Siemens Aktiengesellschaft, Berlin & Munich, Fed. Rep. of Germany

[21] Appl. No.: 638,496

[22] Filed: Aug. 7, 1984

[30] Foreign Application Priority Data

Sep. 9, 1983 [DE] Fed. Rep. of Germany ..... 3332660

[51] Int. Cl.[3] ..... F04B 37/04

[52] U.S. Cl. ..... 417/51

[58] Field of Search ..... 313/7, 551, 481; 417/48, 51

[56] References Cited

U.S. PATENT DOCUMENTS 2,412,302 12/1946 Spencer ..... 417/51 X 4,127,361 11/1978 Hellier et al. ..... 417/48

*Primary Examiner*—Edward K. Look

*Attorney, Agent, or Firm*—Hill, Van Santen, Steadman & Simpson

[57] ABSTRACT

A getter sorption pump has at least one getter member of non-evaporating getter material and a corresponding heating element. The specific performance of the getter pump is increased along with a simultaneous reduction of necessary heating capacity, and it is stabilized over a long time period by use of a heat accumulator having an extremely high heat storing capability. For this purpose, the heating element is attached to a sintered ceramic body, and an insulating tube onto which the getter member is sintered, in situated thereabove. The getter pump is employed in high-vacuum and gas discharge systems.

6 Claims, 1 Drawing Figure

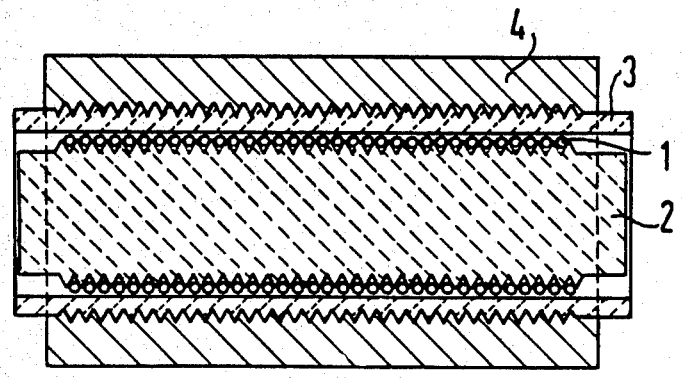
4
3
1
2

GETTER SORPTION PUMP WITH HEAT ACCUMULATOR FOR HIGH-VACUUM AND GAS DISCHARGE SYSTEMS

BACKGROUND OF THE INVENTION

The invention relates to a getter sorption pump for high-vacuum and gas discharge systems comprising at least one getter member of non-evaporating getter material and a corresponding heating element.

In order to achieve a high pump power, a plurality of individual getters had to be previously interconnected. This resulted in the efficiency becoming increasingly deteriorated with respect to the heating capacity, the heat dissipation was intensified, and the space requirement for the accommodation of the individual getters increased. Heating capacity had to be constantly supplied in order to stabilize the pump power over a longer time.

Since the traditional getter substances only develop their optimum pump capabilities for various gases at specific temperatures (selective pump properties), the working temperature either had to be varied, or the individual getters had to be held at different temperatures with at least two heating circuits.

These necessary techniques were usually disregarded in practice, so that the optimum getter properties of the non-evaporating getters remained unexploited. Even a previously disclosed getter pump which has a larger, compact getter member instead of many individual getters, exhibits the most significant of the above described disadvantages.

SUMMARY OF THE INVENTION

An object of the invention is to increase the specific performance of getter pumps given simultaneous reduction of the necessary heating capacity and to stabilize it with the assistance of a heat accumulator having extremely high heat storage capability.

This object is achieved by attaching the heating element to a sintered ceramic body, sintering a getter member onto an insulating tube, and providing the heating element and sintered ceramic body within the insulating tube.

The pump rate of a getter member increases with its surface, i.e. with its porosity as well; but, on the other hand, its capacity increases with its mass. Together, both factors define time-wise stability via the quantity of gas absorbed. This stability is also influenced by the working temperature dependent on the type of gas.

The employment of a gas-permeable sinter tube of ceramic or some other suitable material, for example tungsten powder, offers the highest reliability given arbitrary porosity.

The reduction of the necessary heating capacity in comparison to the employment of many individual getters results from the more efficient exploitation of the heating capacity from the heating element, for example a heating coil (lower radiation losses).

The heat accumulation is achieved by means of the ceramic compound integrated into the structure. The possibilities are extraordinarily flexible and can be expediently optimized.

A further advantage of the energy-saving heat accumulation is that the heat-conditioned, good pump effect is maintained over a longer time after the heating voltage has been shut off. Such a shut-off is, for example, absolutely necessary in nuclear accelerator systems in order to avoid disruptions due to foreign fields.

The slow cooling of the getter member also has an advantageous effect since the temperature-dependent, selective optimum pump ranges are very slowly traversed, and thus all important absorption maximums dependent on the type of gas are covered.

BRIEF DESCRIPTION OF THE DRAWINGS

A preferred embodiment of the getter sorption pump of the invention is shown in cross-section in the drawing FIGURE.

DESCRIPTION OF THE PREFERRED EMBODIMENTS

The FIGURE shows the getter sorption pump in a schematic section. This structure is distinguished by an extremely high heat storing capability. The heating element 1 of the getter sorption pump is attached in the form of a heating coil to a solid sintered ceramic body 2 which is provided with a thread. An insulating tube 3 consisting of ceramic and provided with a thread is situated thereabove. The getter member 4 is sintered onto the insulating tube 3, automatically meshing as a result of its shape.

The getter member 4 shown in the drawing FIGURE consists or is comprised of zirconium, thorium, tantalum, platinum, niobium, cerium, palladium, and mixtures or alloys thereof.

Although various minor changes and modifications might be proposed by those skilled in the art, it will be understood that I wish to include within the claims of the patent warranted hereon all such changes and modifications as reasonably come within my contribution to the art.

I claim as my invention:

1. In a getter sorption pump for high-vacuum and gas discharge systems having at least one getter member of non-evaporating getter material and a corresponding heating element, the improvement comprising:

the element being attached to a sintered ceramic body; and an insulating tube onto which the getter member is sintered externally thereto, said heating element and sintered ceramic body being located within the insulating tube.

2. A getter sorption pump according to claim 1 wherein said attached heating element is in the form of a heating coil; the sintered ceramic body is solid and is provided with a thread; and the insulating tube comprises ceramic and has an external thread, said getter member being sintered onto the insulating tube thread.

3. A getter sorption pump according to claim 1 wherein said getter member comprises one of the elements selected from the group consisting of zirconium, thorium, tantalum, platinum, niobium, cerium, palladium, and mixtures or alloys thereof.

4. A getter assembly for use in a getter sorption pump for high-vacuum or gas discharge systems, comprising:

a solid sintered cylindrical ceramic body;

a heating element wound on the cylindrical body;

an insulating tube within which the solid sintered ceramic body with heating coil is inserted; and a getter member externally surrounding and attached to the insulating tube.

5. The getter assembly according to claim 4 wherein the insulating tube has ridges on an external peripheral surface thereof and the getter member is sintered into intimate contact with the ridges on the insulating tube.

6. A getter assembly for use in a getter sorption pump for high-vacuum or gas discharge systems, comprising:

a ceramic body;

a heating element wrapped on the ceramic body;

an insulating member substantially surrounding the ceramic body and heating element; and a getter member in intimate contact with the insulating member.

* * * * *